United States Patent [19]

Miller

[11] 4,413,826

[45] Nov. 8, 1983

[54] GOLF TRAINING AID

[75] Inventor: Gardner H. Miller, Albuquerque, N. Mex.

[73] Assignee: Trustroke International, Inc., Albuquerque, N. Mex.

[21] Appl. No.: 398,112

[22] Filed: Jul. 14, 1982

[51] Int. Cl.[3] ..... A63B 69/36

[52] U.S. Cl. ..... 273/186 C; 273/192

[58] Field of Search ..... 273/192, 183 R, 186 C, 273/35 R, 186 R, 191 R

[56] References Cited

U.S. PATENT DOCUMENTS

| | | | |
|---|---|---|---|
| 1,545,648 | 7/1925 | Fletcher | 273/192 |
| 2,150,580 | 3/1939 | Crowley | 273/35 |
| 2,169,407 | 7/1939 | Crowley | 273/35 |
| 3,332,688 | 7/1967 | Gevertz | 273/186 |
| 3,860,247 | 1/1975 | Taylor | 273/186 C |
| 3,868,116 | 2/1975 | Ford et al. | 273/186 C |
| 3,885,796 | 5/1975 | King | 273/186 C |
| 3,899,180 | 8/1975 | Rodman | 273/183 R |
| 4,230,319 | 10/1980 | Lindner | 273/192 |

FOREIGN PATENT DOCUMENTS

| | | | |
|---|---|---|---|
| 218526 | 5/1957 | Australia | 2/192 |

*Primary Examiner*—George J. Marlo

*Attorney, Agent, or Firm*—Richards, Harris & Medlock

[57] ABSTRACT

A golf training aid (10) is provided and includes a pair of telescopically extendable rails (16, 18) and a pair of adjustable slide rails (26, 30). Screws (38, 48) interconnect rails (16, 18) and rails (26, 30) in an operational position and folded storage position.

5 Claims, 3 Drawing Figures

GOLF TRAINING AID

TECHNICAL FIELD

This invention relates to an improved golf training aid, and more particularly to a putting aid that is collapsible for easy storage in a golf bag.

BACKGROUND ART

The objective of all putting aids is to help the golfer develop and retain a superior putting stroke. Essentially, a superior putting stroke is one in which the putter blade follows the initial portion of the intended path to the cup. For short and medium putts, this is accomplished by stroking the putter straight back and straight through the initial portion of the intended path, while keeping the face of the putter blade perpendicular to the stroke path. For longer putts, a more pronounced backstroke and throughstroke is required whereby the putter blade is carried slightly inside the line of the stroke path at the extremes of the stroke. For all putts, however, the vertical distboards were parallel. Moreover, for longer putts, it was necessary to reposition the boards to provide a larger distance therebetween to allow the putter blade to be brought slightly inside the line in the back and throughstrokes.

Accordingly, several putting aids have developed stemming from the "two-board" concept that are lightweight and collapsible, thus, providing an advancement in convenience and portability over the two-by-four approach. Representative of these putting aids, for example, is U.S. Pat. No. 2,169,407 which provides a lightweight and collapsible putting aid utilizing a pair of parallel guides between which a golfer strokes the golf ball. However, the previously developed devices that are collapsible generally do not collapse to a size and configuration convenient for storage in the side pocket of a golf bag, and are complicated and difficult to assemble. Moreover, such devices do not provide putting aids with which both short and long putts may be practiced without having to readjust the distance between the parallel guides.

Accordingly, there is a need for an improved putting aid that is collapsible to a size and configuration convenient for storage in the side pocket of a golf bag, that is easy to assemble, and that may be used for practicing both short and long putts without havng to readjust the distance between the putting guides.

DISCLOSURE OF THE INVENTION

In accordance with the present invention, a putting aid is provided that includes a pair of elongated, telescopically extendable rails and a pair of adjustable slide rails interposed between the distal ends of the extendable rails.

The putting aid of the present invention is easy to assemble, yet is collapsible for storage in a convenient, unitary and rigid configuration.

BRIEF DESCRIPTION OF THE DRAWINGS

The present invention can be more completely understood by reference to the following Detailed Description taken in conjunction with the accompanying Drawings in which.

DETAILED DESCRIPTION

Figure 1:
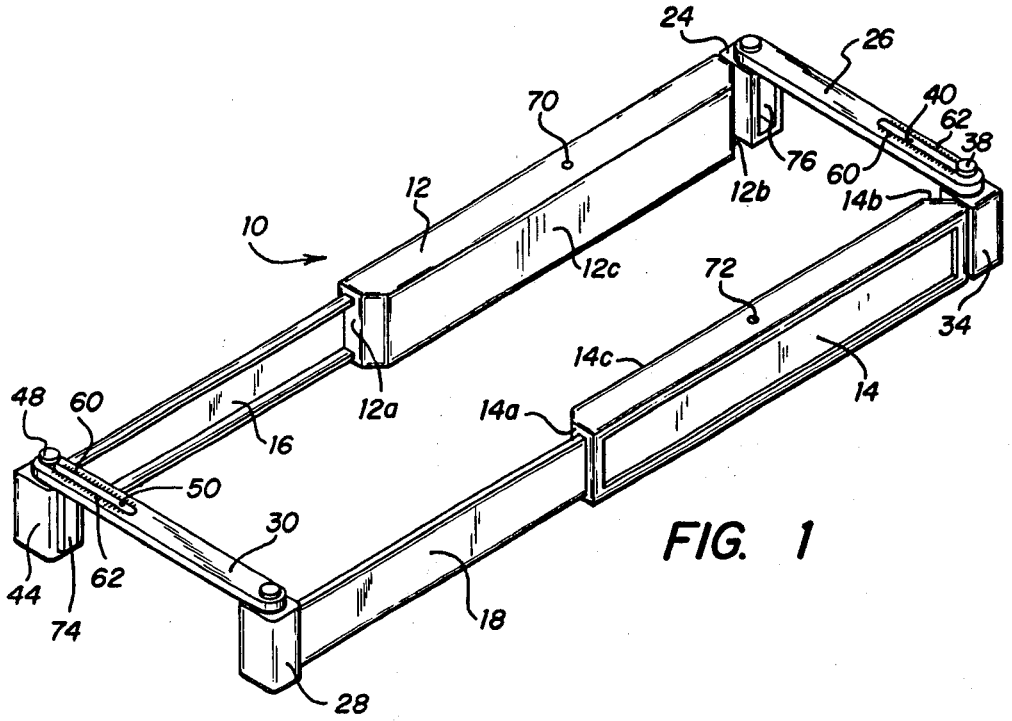
FIG. 1 is a perspective view of the putting aid of the present invention in the extended operational position.
Figure 2:
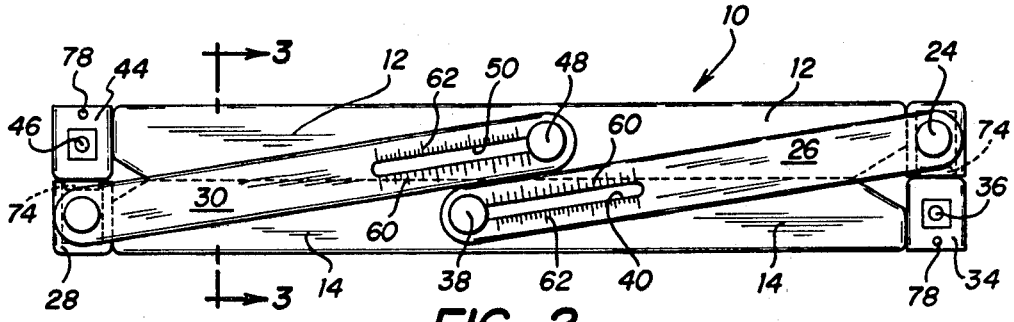
FIG. 2 is a top view of the present invention in the folded stowed position.
Figure 3:
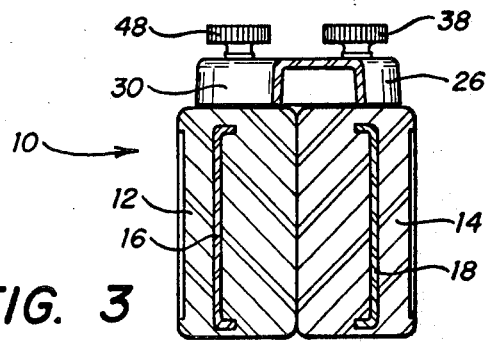
FIG. 3 is a cross section view taken generally along sectional lines 3—3 of FIG. 2.

Referring simultaneously to FIGS. 1, 2 and 3, the putting aid of the present invention is illustrated and is generally identified by the numeral 10. Putting aid 10 includes a pair of elongated housing members 12 and 14. Slidably mounted within housing member 12 and exiting from end 12*a* of housing member 12 is an extension rail 16. Similarly, slidably mounted within housing member 14 and exiting from end 14*a* of housing member 14 is an extension rail 18. As is more clearly illustrated in FIG. 3, extension rails 16 and 18 are "U" shaped in cross section and are completely contained within housing members 12 and 14, respectively, in the folded stowed position of putting aid 10 as illustrated in FIG. 2.

Integrally connected to end 12*b* of housing member 12 is a swivel post 24 for pivotally supporting a slide rail 26. Slide rail 26 is movable between the extended operation position of putting aid 10 as illustrated in FIG. 1 to the folded stowed position illustrated in FIG. 2. Integrally interconnected to extension rail 18 is a swivel post 28 for pivotally supporting a slide rail 30. Slide rail 30 is movable in a manner similar to slide rail 26 between the extended operation position of putting aid 10 as illustrated in FIG. 1 to the folded stowed position as illustrated in FIG. 2.

Integrally interconnected to end 14*b* of housing member 14 is an end post 34 which includes a threaded aperture 36. Threaded aperture 36 receives a screw 38 which is carried by slide rail 26. Screw 38 is carried within an elongated slot 40 contained within slide rail 26.

Integrally interconnected to extension rail 16 is an end post 44 including a threaded aperture 46. Threaded aperture 46 receives a screw 48 which is carried by slide rail 30. Screw 48 is slidable within an elongated slot 50 within slide rail 30. It therefore can be seen that by positioning screws 38 and 48 within elongated slots 40 and 50 of slide rails 26 and 30, the spacing between housing members 12 and 14 in the extended operation position of putting aid 10 can be selectably changed. When the desired distance between housing members 12 and 14 is achieved, screws 38 and 48 are tightened to engage threaded apertures 36 and 46, respectively, such that a rectangular rigid structure is formed by slide rails 26 and 30 as ends and, extension rails 16 and 18 and housing members 12 and 14 as sides of putting aid 10.

Once putting aid 10 has been properly assembled by pivoting slide rails 26 and 30 perpendicularly to housing members 12 and 14 and extending extension rails 16 and 18 from housing members 12 and 14, the golfer adjusts the distance between housing members 12 and 14 so that there is sufficient space for the putter blade to pass therebetween with the putter blade oriented such that the face thereof is perpendicular to the interior walls 12*c* and 14*c* of housing members 12 and 14. In the preferred embodiment of the present putting aid 10, slide rails 26 and 30 are dimensioned such that the space between housing members 12 and 14 can be varied from approximately four inches to approximately seven inches to thereby accommodate a variety of putter blade sizes. The adjustment to accommodate varying sized putter blades is accomplished by loosening screws 38 and 48 within elongated slots 36 and 46 until the desired spacing is achieved. When this spacing is achieved, screws 38 and 48 are tightened such that slide rails 26 and 30 are rigidly attached to end posts 34 and 44, respectively.

To assist the golfer in adjusting putting aid 10 so that housing members 12 and 14 are parallel, indicia 60 shown in inches and indicia 62 shown in centimeters are contained on slide rails 26 and 30 adjacent elongated slots 40 and 50. Using indicia 60 or 62, slide rails 26 and 30 can be adjusted so that the positioning of screw 38 in elongated slot 40 will lie at the same position as screw 48 within elongated slot 50.

Putting aid 10 may be used in practicing both short and long putts without the necessity of readjusting the distance between housing members 12 and 14 because the distance between slide rails 26 and 30 is greater than the distance between housing members 12 and 14. This aspect of the present invention makes it possible for the golfer to bring the putter slightly inside the line of the initial portion of the intended path to the cup on the back and through stroke which is necessary for longer putts. However, at the same time, putting aid 10 requires the golfer to stroke the putter between the interior walls **12*c* and 14*c* of housing members 12 and 14** through the critical portion of both short and long putts.

As illustrated in FIGS. 2 and 3, puttting aid 10 collapses to a size and configuration convenient for storage in a golf bag. To collapse putting aid 10, screws 38 and 48 are loosened such that slide rail 26 disengages from end post 34 and slide rail 30 disengages from end post 44. Extension rail 16 is telescopically inserted into housing member 12 and extension rail 18 is telescopically inserted into housing member 14. Housing members 12 and 14 are then brought into contact along their interior side walls **12*c* and 14*c* (FIG. 1) to permit slide rails 26 and 30 to pivot about swivel posts 24 and 28, respectively, to achieve the position illustrated in FIG. 2. After rotation of slide rail 26 and 30, screw 48 is positioned at the end of elongated slot 50 to engage a threaded aperture 70 (FIG. 1) contained within housing member 12 and screw 38 is positioned at the end of elongated slot 40 of slide rail 26 to engage a threaded aperture 72 (FIG. 1) contained within housing member 14. Upon tightening screws 38 and 48, housing members 12 and 14 are rigidly held together to maintain putting aid 10 in the folded stowed position illustrated in FIG. 2**.

In order to maintain extension rails 16 and 18 within housing members 12 and 14, respectively in the folded stowed position, end posts 34 and 44 include a locking boss 74 (FIG. 1) which is received by a recess 76 within swivel posts 24 and 28, respectively.

As illustrated in FIG. 2, end posts 34 and 44 include an aperture 78 for receiving a golf tee to thereby allow the user of putting aid 10 to secure putting aid 10 to the ground with the use of a pair of golf tees.

The present putting aid 10 is lightweight in construction and can be fabricated by injection molding of plastic to provide for a durable and maintenance free structure.

A further embodiment of the present putting aid 10 can include a second set of extension rails 16 and 18 slidably mounted within housing members 12 and 14, respectively, and exiting from ends **12*b* and 14*b* similiar to extension rails 16 and 18 shown in FIG. 1. In this further embodiment the length of putting aid 10 would be approximately twice that shown in FIG. 1** for use in assisting the golfer on longer putts.

It therefore can be seen that the present invention provides for a golf putting aid which is collapsible to a size and configuration convenient for storage in a golf bag as well as being easy to assemble for the practice of both short and long putts.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A golf training aid comprising:

first and second elongated telescopically extendable rail means each having first and second ends and being extendable to an operational position or retracted to a storage position;

first elongated adjustable slide rail means having first and second ends, said first end thereof being pivotally connected to said first end of said first elongated telescopically extendable rail means, said second end thereof being selectively pivotally connected to said first end of said second elongated telescopically extendable rail means in said operational position to thereby rigidly couple said first ends of said first and second elongated telescopically extendable rail means in said operational position;

second elongated adjustable slide rail means having first and second ends, said first end thereof being pivotally connected to said second end of said first elongated telescopically extendable rail means, said second end thereof being selectively pivotally connected to said second end of said second elongated telescopically extendable rail means in said operational position to thereby rigidly couple said second ends of said first and second elongated telescopically extendable rail means in said operational position;

said first and second elongated adjustable slide rail means being disposed substantially perpendicular to said first and second elongated telescopically extendable rail means to thereby maintain said first and second elongated telescopically extendable rail means in a preselected spaced apart relationship throughout the entire length of said first and second elongated telescopically extendable rail means in said operational position;

said first and second elongated adjustable slide rail means being disposed transversely to said first and second elongated telescopically extendable rail means in said storage position such that said first and second elongated telescopically extendable rail means contact each other to enable the golf training aid to collapse to a compact configuration; and means for rigidly locking together said elongated telescopically extendable rail means and said elongated adjustable slide rail means in said operational position and said storage position.

2. The golf training aid of claim 1 and further including:

means for interconnecting said second end of said first elongated adjustable slide rail means between said first and second ends of said first elongated telescopically extendable rail means and means for interconnecting said second end of said second elongated adjustable slide rail means between said first and said second ends of said second elongated telescopically extendable rail means in said storage position.

3. The golf training aid of claim 2 wherein said first and second elongated adjustable slide rail means include slotted apertures for receiving said locking means, such that the spacing between said first and second elongated telescopically extendable rail means is selected by varying the position of said locking means in said slotted apertures.

4. The golf training aid of claim 3 wherein said first and second elongated adjustable slide rail means includes indexing indicia disposed adjacent said slotted apertures.

5. The golf training aid of claim 1 wherein said locking means includes:

boss means disposed on said first end of said first elongated telescopically extendable rail means; and said first end of said second elongated telescopically extendable rail means includes an aperture for receiving said boss means.

* * * * *

UNITED STATES PATENT AND TRADEMARK OFFICE

CERTIFICATE OF CORRECTION

PATENT NO. : 4,413,826

DATED : November 8, 1983

INVENTOR(S) : Gardner H. Miller

It is certified that error appears in the above—identified patent and that said Letters Patent is hereby corrected as shown below:

Column 1, line 23 delete "distboards" after "vertical" should read --distance between the ground and the bottom of the putter blade varies from essentially zero, at impact, to a few inches at the extremes of the stroke. This is known as keeping the putter blade low.

Previously developed putting aids have been designed to help the golfer develop a "straight back and straight through" putting stroke. Golfers have practiced by placing a pair of two-by-four boards parallel to one another and spaced apart a distance sufficient to accommodate a putter blade. The golfer would then practice putting while attempting not to contact the boards. It will, however, be readily appreciated that the use of two-by-fours on the golf course has several drawbacks. For example, the two-by-fours were inconvenient and cumbersome to carry around. It was also difficult to assure that the boards--.

Signed and Sealed this

*Seventh* Day of *February 1984*

[SEAL]

*Attest:*

GERALD J. MOSSINGHOFF

*Attesting Officer*

*Commissioner of Patents and Trademarks*